US010654069B2

(12) United States Patent
Jördens et al.

(10) Patent No.: US 10,654,069 B2
(45) Date of Patent: May 19, 2020

(54) COATING OF USAGE SURFACES WITH PLASMA POLYMER LAYERS UNDER ATMOSPHERIC PRESSURE IN ORDER TO IMPROVE THE CLEANABILITY

(71) Applicant: BSH Hausgeräte GmbH, Munich (DE)

(72) Inventors: Frank Jördens, Traunstein (DE); Jürgen Salomon, Trostberg (DE); Philipp Schaller, Traunreut (DE); Gerhard Schmidmayer, Bad Endorf (DE)

(73) Assignee: BSH Hausgeräte GmbH, Munich (DE)

( * ) Notice: Subject to any disclaimer, the term of this patent is extended or adjusted under 35 U.S.C. 154(b) by 504 days.

(21) Appl. No.: 14/890,464

(22) PCT Filed: May 5, 2014

(86) PCT No.: PCT/EP2014/059104
§ 371 (c)(1),
(2) Date: Nov. 11, 2015

(87) PCT Pub. No.: WO2014/187663
PCT Pub. Date: Nov. 27, 2014

(65) Prior Publication Data

US 2016/0082471 A1 Mar. 24, 2016

(30) Foreign Application Priority Data

May 24, 2013 (DE) ..... 10 2013 209 709

(51) Int. Cl.
*B05D 1/00* (2006.01)
*B05D 5/08* (2006.01)
(Continued)

(52) U.S. Cl.
CPC ..... *B05D 1/62* (2013.01); *B05D 5/00* (2013.01); *B05D 5/08* (2013.01); *B05D 7/54* (2013.01);
(Continued)

(58) Field of Classification Search
CPC ... B05D 1/62; B05D 5/00; B05D 5/08; B05D 7/54; B05D 3/12; B05D 5/086;
(Continued)

(56) References Cited

U.S. PATENT DOCUMENTS 5,041,304 A 8/1991 Kusano et al.
6,599,594 B1 7/2003 Walther et al.
(Continued)

FOREIGN PATENT DOCUMENTS

DE 10320297 A1 12/2004

OTHER PUBLICATIONS

Lommatzsch et al. "Plasma Polymerization of HMDSO with an Atmospheric Pressure Plasma Jet for Corrosion Protection of Aluminum and Low-Adhesion Surfaces" Plasma Process Polym. 2009, 6, 642-648. (Year: 2009).*
(Continued)

*Primary Examiner* — Robert S Walters, Jr.
(74) *Attorney, Agent, or Firm* — Michael E. Tschupp; Andre Pallapies; Brandon G. Braun

(57) ABSTRACT

In a method for applying an easily cleanable surface to a domestic article, a polymer surface layer is deposited by one or more nozzles on at least a part of the surface of the domestic article by plasma polymerization in the presence of an atmospheric pressure plasma based on at least one precursor.

17 Claims, 1 Drawing Sheet

(51) Int. Cl.

| | |
|---|---|
| ***F24C 15/00*** | (2006.01) |
| ***B05D 5/00*** | (2006.01) |
| ***B05D 7/00*** | (2006.01) |
| *B05D 3/12* | (2006.01) |

(52) U.S. Cl.
CPC ..... *F24C 15/005* (2013.01); *B05D 3/12* (2013.01); *B05D 5/086* (2013.01); *B05D 2202/00* (2013.01); *B05D 2203/30* (2013.01); *B05D 2203/35* (2013.01); *B05D 2506/10* (2013.01); *B05D 2518/10* (2013.01)

(58) Field of Classification Search
CPC ..... B05D 2202/00; B05D 2203/30; B05D 2203/35; B05D 2506/10; B05D 2518/10; F24C 15/005
See application file for complete search history.

(56) References Cited

U.S. PATENT DOCUMENTS 7,157,145 B2 1/2007 Vissing et al.
2004/0180210 A1 9/2004 Vissing et al.
2007/0065680 A1* 3/2007 Schultheis ..... C03C 17/3405 428/702
2007/0148407 A1* 6/2007 Chen ..... B05D 1/62 428/141
2009/0130330 A1 5/2009 Haupt et al.
2011/0262768 A1 10/2011 Jaehrling et al.

OTHER PUBLICATIONS

Palumbo et al. "On Low Pressure Plasma Processing for Metal Protection" Plasma Processes and Polymers, 2009, 6, S684-S689.*
Shirafuji et al. "PE-CVD of Fluorocarbon/SiO Composite Thin Films Using C4F8 and HMDSO" Plasmas and Polymers, vol. 4, No. 1, 1999.*
Vogelsang et al. "Hydrophobic coatings deposited with an atmospheric pressure microplasma jet" Journal of Physics D: Applied Physics, IOP Publishing, 2010, 43 (48), pp. 485201. (Year: 2010).*
International Search Report PCT/EP2014/059104 dated Sep. 8, 2014.
National Search Report DE 10 2013 209 709.3 dated Feb. 14, 2014.

* cited by examiner

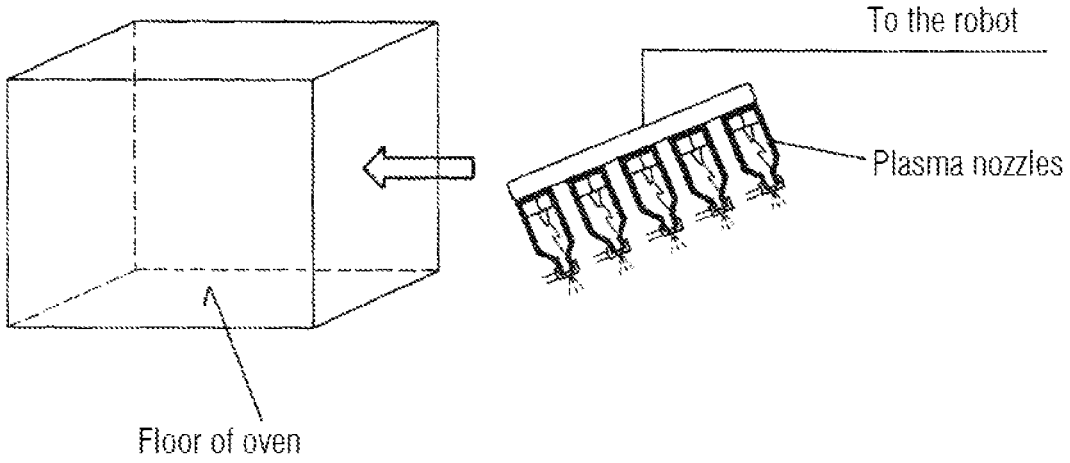
To the robot
Plasma nozzles
Floor of oven

COATING OF USAGE SURFACES WITH PLASMA POLYMER LAYERS UNDER ATMOSPHERIC PRESSURE IN ORDER TO IMPROVE THE CLEANABILITY

BACKGROUND OF THE INVENTION

The present invention relates to a method for depositing a plasma polymer layer onto usage surfaces made of enamel, glass, glass ceramic or metal, which is characterized in that the application of the surface coating takes place in the atmospheric pressure plasma.

The present invention further relates to domestic articles, the surface of which, made of enamel, glass, glass ceramic or metal, has been coated using the aforementioned method.

PRIOR ART

The creation of an easily cleanable surface made of enamel, glass, glass ceramic or metal is based on reducing its surface energy. Thus for example, glasses, glass ceramics and enamels have surface energies of more than 40 mN/m with a distinct polar component because of their oxidic composition (including $SiO_2$, $Al_2O_3$, $Na_2O$, $K_2O$). Metals exhibit a similar behavior, since the metal/air boundary layer always has an oxide layer. This polar component is responsible for the good adhesion of burned-in food residues (oils, starch, sugar, etc.).

Hence in the past attempts have been made to lessen the surface energy using a coating from the liquid phase and to reduce the polar component to 0 mN/m. A coating containing silicone polymers (EP 0 937 012 B1) or PTFE-based coatings (DE 19 833 375 A1) are known for enamel, for example. Furthermore, EP 1 858 819 A1 discloses coatings using polysiloxanes enriched with radical interceptors. A general characteristic of these coatings is that the coating material is applied to the substrate in liquid form and then (possibly after drying) has to be burned in at a higher temperature (c. 150° C.-400° C.), as a result of which this coating method is energy-intensive and time-consuming.

Furthermore, if it is desired to coat selected partial surfaces, the aforementioned methods necessarily entail further masking steps, which considerably increase the time required.

Furthermore, the aforementioned methods frequently rely on the use of solvents and therefore are disadvantageous in respect of protection of the environment.

Hence there is a need for alternative methods which permit quick, clean, environmentally friendly and low-cost coating, which if necessary can be carried out selectively without additional masking steps.

BRIEF DESCRIPTION OF THE INVENTION

According to the invention the pollution problem described is solved in that the surface-energy-reducing coating is obtained on at least a part of the surface (including the substrate surface) using a plasma polymerization process under atmospheric pressure conditions.

In detail the present invention provides a method for applying easily cleanable surfaces to domestic articles, which is characterized in that a polymer surface layer is deposited with the help of an atmospheric pressure plasma on at least a part of the substrate surface of the domestic article, e.g. consisting of glass, enamel, glass ceramic or metal, using one or more nozzles and based on one or more precursors.

The atmospheric pressure plasma is created in a preferred embodiment by a plasma generator with an output frequency in the range between 1 kHz and 1 MHz.

In a further preferred embodiment one or more precursors are selected from the group consisting of compounds containing fluorine and carbon and/or organosilicon compounds. The compound containing fluorine and carbon is furthermore preferably perfluorocyclobutane (PFCB) and the organosilicon compound is preferably hexamethyldisiloxane (HMDSO).

In one embodiment the layer thickness of the deposited polymer surface layer is approximately 10 nm to 10 approximately μm.

In one embodiment, an adhesion-enhancing layer can be deposited prior to the deposition of the polymer surface layer by means of plasma polymerization. Preferably the adhesion-enhancing layer contains $SiO_2$.

In a preferred embodiment, the part of the substrate surface is roughened prior to the deposition of the polymer surface layer by means of plasma polymerization.

In a further embodiment a plurality of nozzles can be arranged in series to form an array in order to coat large areas.

Furthermore, the present invention provides a domestic article which has at least one partial surface, preferably consisting of glass, enamel, glass ceramic or metal, which can be coated with the help of the methods described above, wherein the polymer surface layer has practically no polar groups.

In a preferred embodiment an adhesion-enhancing layer preferably containing $SiO_2$ is located between the partial surface consisting of glass, enamel, glass ceramic or metal, and the polymer surface layer.

In preferred embodiments the domestic article referred to above is a kitchen appliance, particularly preferably a baking oven muffle.

BRIEF DESCRIPTION OF THE DRAWING

FIG. 1 illustrates an exemplary embodiment of the invention.

DETAILED DESCRIPTION OF THE INVENTION

According to the present invention the surface-energy-reducing coating is carried out using a plasma polymerization process under atmospheric pressure conditions.

Generally the term atmospheric-pressure plasma (also called AP plasma or normal-pressure plasma) refers to a plasma in which the pressure approximately matches that of the surrounding atmosphere referred to as normal pressure.

The inventive coating method is executed by exciting suitable precursors in a nozzle in which an electrically excited plasma is ignited so that they form a low-energy surface on the surface of the substrate (made of enamel, glass, glass ceramic or metal). Specifically a pulsed arc is generated in the plasma nozzle by means of high-voltage discharge. A precursor gas, which is generally streamed past this gap, is excited and is transformed into the plasma state. This plasma then reaches the substrate surface to be coated through a nozzle head.

All currently available generators can in principle be used as an energy source for the plasma. For example, radio-frequency or high-frequency generators can be used (from the kHz range to the GHz range). In a preferred embodiment kHz sources can be used (i.e. plasma generators with an output frequency in the range between 1 kHz and 1 MHz).

Compounds containing fluorine and carbon and/or organosilicon compounds are preferably used as precursor gases. Siloxanes, for example hexamethyldisiloxane (HMDSO), can be cited as examples of organosilicon precursors. Compounds containing fluorine and carbon are preferably fluorocarbons, for example perfluorcyclobutane (PFCB).

It is also conceivable to apply an adhesion-enhancing layer (e.g. a layer containing SiO2) initially using this method, and then to create a low-energy surface by varying the process conditions or changing the precursor.

Depending on the mechanical load to be set of the coating it may be advantageous, independently of this, to use compounds containing fluorine and carbon in combination with organosilicon compounds or hydrocarbons as precursor material.

The process is designed such that either multi-layered structures are implemented or else gradient layers are deposited by continuously changing the proportions of precursor gas, said gradient layers being very hard and resistant on the substrate side and toward the outer surface having ever more polymer properties, but on the other hand poor adhesive properties.

Furthermore the process gas can contain, besides the compounds containing fluorine and carbon and organosilicon precursors or hydrocarbons, additional residual gases, such as noble gases (e.g. argon), oxygen, nitrogen, carbon dioxide, carbon tetrachloride and gas mixtures, providing this does not have a deleterious effect on the conduct of the process and the resulting coating.

Thus the inventive method provides, not least because of the easily creatable layer properties, an effective and above all relatively inexpensive solution to the problems described in the introduction that is efficient in the long term.

The coating thickness can be selected as a function of the desired properties and the composition of the precursor. In general the thickness of the individual layers is less than 100 μm, preferably approximately 10 nm to approximately 10 μm.

Overall it is possible with the proposed method to create especially temperature-stable, chemically resistant and—if necessary—transparent non-adhesive layers.

In a preferred embodiment the non-adhesive effect is additionally improved by roughening the surface prior to coating. Thanks to the resulting low-energy coating the water only wets the peaks and can thus convey particles of dirt adhering to the surface away more easily during the run-off (the "lotus effect").

Since when using a plasma beam as opposed to the spray application of a liquid coating no spray mist forms and the plasma beam is thus spatially restricted, it is also readily possible to partially part-coat the surface without masking.

A plurality of plasma nozzles can also be arranged in series in order to coat a large area (e.g. of the floor of an oven). This array thus enables even large areas to be coated quickly and uniformly, e.g. by a robot (see FIG. 1).

Furthermore, the deposition of the plasma polymer layer under atmospheric conditions does not require any solvent, which means the inventive method is advantageous from an environmental perspective compared to conventional liquid coatings.

Compared to surfaces applied using wet chemicals it is possible, by using suitable precursor and method parameters, to create absolutely non-polar surfaces that have practically no polar groups that would encourage adhesion.

According to the present invention a kitchen appliance is likewise provided, the surface of which has been coated at least in part according to the methods described above.

The present invention furthermore relates to a domestic article which has a usage surface made of enamel, glass, glass ceramic or metal, which has been coated at least in part according to the methods described above, characterized in that the coated surface has practically no polar groups.

The domestic article in accordance with the present invention includes both non-electrical kitchen appliances (e.g. cookware, pans, roasting pans), electrical kitchen appliances (e.g. mixers, baking ovens, grill devices, refrigerators or microwaves) and other domestic appliances and furniture which have at least one partial surface made of enamel, glass, glass ceramic or metal (e.g. glass doors, operating panels). In a preferred embodiment the domestic article is a baking oven, particularly preferably a baking oven muffle.

The coated surface of the inventive domestic article is generally characterized in that it has practically no polar groups. The surface energy of the coated surface is preferably 40 mN/m or less, particularly preferably less than 20 mN/m. Preferably the polar component of the surface energy is less than 5 mN/m, further preferably less than 1 mN/m, particularly preferably less than 0.5 mN/m, especially preferably 0 mN/m. The measurement of the surface energy and the determination of the polar and disperse components thereof are carried out in accordance with customary methods known to the person skilled in the art (e.g. contact angle measurement and methods in accordance with ZISMAN or OWEN, WENDT, RABEL & KAELBE).

The invention claimed is:

1. A method for applying an easily cleanable surface to a domestic article, comprising depositing a polymer surface layer by one or more nozzles on at least a part of the surface of the domestic article by plasma polymerization in the presence of an atmospheric pressure plasma based on at least one precursor, wherein the at least one precursor includes a compound containing fluorine and carbon and an organosilicon compound, wherein the compound containing fluorine and carbon includes at least perfluorocyclobutane (PFCB) and the organosilicon compound includes at least hexamethyldisiloxane (HMDSO), and wherein the deposited polymer surface layer has a surface energy with a polar component of less than 5 mN/m, wherein the atmospheric-pressure plasma is created by a plasma generator with an output frequency in a range between 1 kHz and 1 MHz.

2. The method of claim 1, wherein the domestic article is made of a material selected from the group consisting of glass, enamel, glass ceramic and metal.

3. The method of claim 1, wherein the deposited polymer surface layer has a layer thickness which is approximately 10 nm to approximately 10 μm.

4. The method of claim 1, further comprising depositing an adhesion-enhancing layer prior to depositing the polymer surface layer by the plasma polymerization.

5. The method of claim 4, wherein the adhesion-enhancing layer contains $SiO_2$.

6. The method of claim 1, further comprising roughening the part of the surface of the domestic article prior to depositing the polymer surface layer by the plasma polymerization.

7. The method of claim 1, wherein the at least one or more nozzles are a plurality of nozzles arranged in series.

8. The method of claim 1, wherein the domestic article is a kitchen appliance.

9. The method of claim 1, wherein the domestic article is a baking oven muffle.

10. The method of claim 1, wherein the deposited polymer surface layer has substantially no polar groups.

11. The method of claim 1, wherein the deposited polymer surface layer has a surface energy with a polar component of less than 1 mN/m.

12. The method of claim 1, wherein the deposited polymer surface layer has a surface energy with a polar component of less than 0.5 mN/m.

13. The method of claim 1, wherein the deposited polymer surface layer has a surface energy with a polar component of less than 0 mN/m.

14. The method of claim 1, wherein the deposited polymer surface layer has a surface energy of less than or equal to 40 mN/m.

15. The method of claim 1, wherein the deposited polymer surface layer has a surface energy of less than or equal to 20 mN/m.

16. A method for applying an easily cleanable surface to a domestic article, comprising:

preparing at least a part of a surface of the domestic article by at least one of depositing an adhesion-enhancing layer including $SiO_2$ on the part of the surface of the domestic article and roughening the part of the surface of the domestic article; and depositing a polymer surface layer by one or more nozzles on the part of the surface of the domestic article by plasma polymerization in the presence of an atmospheric pressure plasma based on at least one precursor, wherein the domestic article is made of at least one of glass, enamel, glass ceramic, and metal, wherein the at least one precursor includes at least perfluorocyclobutane (PFCB) and at least hexamethyldisiloxane (HMDSO), wherein the atmospheric-pressure plasma is created by a plasma generator with an output frequency in a range between 1 kHz and 1 MHz, and wherein the deposited polymer surface layer has a surface energy of less than or equal to 40 mN/m and a polar component of less than 5 mN/m.

17. A method for applying an easily cleanable surface to a domestic article at atmospheric pressure, the method comprising:

preparing at least a part of a surface of the domestic article by at least one of depositing an adhesion-enhancing layer including $SiO_2$ on the part of the surface of the domestic article and roughening the part of the surface of the domestic article, wherein the domestic article is made of at least one of glass, enamel, glass ceramic, and metal; and uniformly depositing, using a plurality of nozzles arranged in series, a polymer surface layer on the part of the surface of the domestic article, under atmospheric conditions and without a solvent and without masking, by plasma polymerization in the presence of an atmospheric pressure plasma based on at least one precursor, wherein the at least one precursor includes at least perfluorocyclobutane (PFCB) and at least hexamethyldisiloxane (HMDSO), wherein the atmospheric-pressure plasma is created by a plasma generator with an output frequency in a range between 1 kHz and 1 MHz, and wherein the deposited polymer surface layer has a surface energy of less than or equal to 40 mN/m and a polar component of less than 5 mN/m.

* * * * *